US006260341B1

(12) United States Patent
Galan I Llongueras

(10) Patent No.: US 6,260,341 B1
(45) Date of Patent: Jul. 17, 2001

(54) MODULAR MACHINE FOR SPINNING AND DOUBLING WITH ELEMENTS FOR TRANSMITTING INDIVIDUALLY THE SPINDLES WITH CONICAL OR DOUBLE CONICAL CONTINUOUS AND INDIVIDUAL FOLDING SYSTEM

(76) Inventor: Jordi Galan I Llongueras, Francesc Oller, 91, E-08225 Tarrassa (ES)

( * ) Notice: Subject to any disclaimer, the term of this patent is extended or adjusted under 35 U.S.C. 154(b) by 0 days.

(21) Appl. No.: 09/180,212

(22) PCT Filed: Mar. 4, 1998

(86) PCT No.: PCT/ES98/00054

§ 371 Date: Jan. 25, 1999

§ 102(e) Date: Jan. 25, 1999

(87) PCT Pub. No.: WO98/39504

PCT Pub. Date: Sep. 11, 1998

(30) Foreign Application Priority Data

| | | |
|---|---|---|
| Mar. 4, 1997 | (ES) | 9700470 |
| Jul. 3, 1997 | (WO) | PCT/ES97/00168 |
| Jan. 8, 1998 | (ES) | 9800015 |

(51) Int. Cl.[7] ..... D01H 7/00
(52) U.S. Cl. ..... 57/1 R; 57/94; 57/100
(58) Field of Search ..... 57/1 R, 92, 93, 57/94, 100, 135, 264; 700/130, 139, 144

(56) References Cited

U.S. PATENT DOCUMENTS

| | | | | |
|---|---|---|---|---|
| 2,138,658 | * | 11/1938 | Hongo | 57/100 |
| 2,296,420 | | 9/1942 | Campbell . | |
| 3,095,687 | * | 7/1963 | Beerli | 57/100 |
| 4,204,653 | | 5/1980 | Nose et al. . | |
| 4,348,860 | * | 9/1982 | Hartmannsgruber | 57/100 |
| 4,420,926 | * | 12/1983 | Remontet | 57/100 |
| 4,562,388 | * | 12/1985 | Wolf | 318/301 |
| 4,817,371 | * | 4/1989 | Wolf | 57/100 |
| 4,904,892 | * | 2/1990 | Hildbrand et al. | 310/217 |
| 4,918,911 | * | 4/1990 | Grau et al. | 57/100 |
| 4,931,705 | * | 6/1990 | Wieczorek | 318/49 |
| 4,980,621 | * | 12/1990 | Muller | 318/269 |
| 5,111,647 | * | 5/1992 | Gabalda | 57/100 |
| 5,161,361 | * | 11/1992 | Talley et al. | 57/264 |
| 5,421,150 | * | 6/1995 | Adolf et al. | 57/1 R |
| 5,572,859 | * | 11/1996 | Derichs et al. | 57/100 |

FOREIGN PATENT DOCUMENTS

| | | |
|---|---|---|
| 0 140 801 | 5/1985 | (EP) . |
| 2 029 459 | 3/1980 | (GB) . |
| 07216664 | 8/1985 | (JP) . |
| 61-201028 | 9/1986 | (JP) . |

* cited by examiner

*Primary Examiner*—John J. Calvert
*Assistant Examiner*—Gary L. Welch
(74) *Attorney, Agent, or Firm*—Akerman Senterfitt

(57) ABSTRACT

Modular machine for spinning and doubling with individual transmission elementos for spindles with continuous, individual, conical or double conical folding system, comprising a frame formed by two metal cabinets connected to each other by means of a central body; the machine further comprises a series of mobile elements; the spindles with their respective driving system, the ring rail on which the travellers turn around, the yarn guide, the feeding system and the control panel, said machine being capable of producing bobbins wound by the conical or double conical continuous, individual, winding system. Said machine can be used for spinning and doubling yarn, cord or similar product in a continuous endless process.

5 Claims, 10 Drawing Sheets

MODULAR MACHINE FOR SPINNING AND DOUBLING WITH ELEMENTS FOR TRANSMITTING INDIVIDUALLY THE SPINDLES WITH CONICAL OR DOUBLE CONICAL CONTINUOUS AND INDIVIDUAL FOLDING SYSTEM

OBJECT OF THE INVENTION

The present invention relates to a modular machine for spinning and doubling with individual transmission elements for spindles, with a continuous and individual conical or double conical folding system, by means of conventional asynchronous alternative current motors controlled by frequency converters and programmed by a control or microprocessor unit.

BACKGROUND OF THE INVENTION

The textile industry uses two types of continuous spinning and doubling, machines which, among other elements, are provided basically with some elements, called spindles, in a number ranging from five to several hundred units in each machine. The spindles turn continuously at the same speed, driven by only one electric motor by means of gear or pulleys assembly. Also, each spindle can be driven by an individual electric motor, with all motors controlled by a frequency variation unit so that all spindles turn at a same speed.

Although these machines have a high efficiency, all of their spindles turn at the same speed. Consequently, they all have to use the same thread type and are unable to combine different thread types in order to perform simultaneous short operations. Therefore, when it is necessary to produce different spinning and doubling operations, it is necessary to adapt the machine to the new process, causing an increase in production costs.

Furthermore, in spinning, doubling, textile spinning, spool roving frame, spool doubling, and similar machines, the thread obtained is stored in spinning bobbins, while the process for doubling the final product has suffered changes. The conventional process consist of the so called "reel" doubling, where the product is wound around a cylindrical reel provided in its upper and lower sides, with rims to prevent the thread from separating from the cylinder. This process had several inconveniences. For example, to carry out the unfolding of the thread in the process, it was necessary to turn the reel to avoid the breakage of the thread due to the strain caused by the pulling of the bobbin. Another inconvenience is that the unfolding had to be performed perpendicularly to the turning axis, in order to avoid thread breakage due to fouling in the bobbin upper rim.

A new reel type was later developed, which was known as "conventional conical." This reel type reduced the upper rim to a diameter slightly larger than that of a central axis, so that the bobbin obtained had a mixed shape, with a conical upper portion. With this new pattern, although some of the previous inconveniences of the previous "reel" type model were eliminated, some problems remained. For example, in order to identify the bobbin pattern, it is necessary to match the cone angle with the number of coats required to obtain the required configuration. It will also be necessary to repeat such process for each reel type provided in the spinning machine, in the case that thread of different types and thicknesses are used, thus affecting the machine efficiency. Another inconvenience is that, when finishing a manufacturing cycle, the machine stops completely, and therefore all spindles stop turning even if they have not completed their process. As a result, time is wasted. Additionally, it is not possible to have bobbins with the same pattern when processing different products in the different spindles of spinning, doubling, textile spinning, spool roving frame, spool doubling, and similar machines.

SUMMARY OF THE INVENTION

With the purpose to prevent all serious inconveniences indicated above, when it is necessary to spin or double small amounts of product and to avoid wasting time relating to machine preparation, an improved modular machine for spinning and doubling with elements for spindles individual transmission has been developed. The invention also relates to a new system for doubling threads and welts as a continuous and individual conical or double conical folding system with a corresponding programming and control unit.

The modular machine for spinning and doubling with elements for spindles individual transmission with a continuous and individual conical or double conical folding system is made of a frame which includes two metal cabinets, one on a left side and one on a right side. The frame has a vertical cubic shape, made preferably in steel plate. The exterior of each cabinet has a pivoting access door. The central portion of the frame connects the two cabinets, fastened by bolts, is provided with cross bars made preferably of welded steel tubes, which act as a support for the different moving elements that will be described hereinafter.

The central portion of the frame contains within the space between both cabinets and held by the crossing tubes, preferably between one and thirty spinning or folding spindles, each having its own driving means. The spindles turn vertical to the axis on which the different types of spinning or folding reels will be mounted. The spindles are held by a twin roller system, of the ball bearing type. The upper bearing unit is packed in connection with a synthetic rubber ring to absorb the radial vibrations, and the lower bearing unit is mounted on a swinging support that is allowed to be displaced radially.

The spindle bottom part has fastened to it a pulley arranged to receive a transmission flat belt, for connection to the output of an induction electrical motor mounted on a pair of crossing tubes placed in the back side of frame.

A ring rail, having a vertical up and down displacement, on which a sliding piece rotates to create the twisting of the thread, is mounted coaxially on the spindle head. Above this ring rail, there is a thread guide having a similar movement but with a different speed. The thread guide guides the different threads towards the sliding piece that comes from the hake box or feeding assembly.

The feeding assembly for each spindle comprises a pair of feeding rollers, an inlet thread roller and a pressure cylinder. The feeding rollers, made preferably of chromed carbon steel, are driven by means of two horizontal shafts, which are also driven, through a flat belt transmission system, by an alternate current motor. The current motor is controlled by a conventional frequency variator. The variator is controlled by a potentiometer. The entire feeding assembly is located in the cabinet. The shafts are made of carbon steel and go through one cabinet to the other, and are supported by the cabinets. One shaft is located vertically above the other, and the shafts are connected to each other by means of a chain that makes them turn in the same direction. The pressure roller is located between the two feeding rollers and exerts a pressure on the thread in order to obtain a better draw. The pressure roller is held by ball bearings. The pressure arm is also fastened by bearings to another vertical shaft placed on top of those supported by the feeding rollers. The pressure arm is allowed to move radially when actuated by a pneumatic piston as to exert more or less pressure on threads moving through the pressure roller and feeding rollers. The pneumatic pistons acting on the pressure rollers of the feeding system in each spindle are driven by the pressured air flow coming from the air pressure piping system, with pressure regulated by a pressure control valve located in the cabinet.

In the modular machine for spinning and doubling with elements for spindle individual transmission with conical or double conical continuous and individual folding system, spindles are the main elements that are in continuous movement, and are able to turn at different speeds. The ring rail has a vertical up and down movement, with the sliding pieces and thread guides turning around and having, as in the case of the ring rail, a vertical up and down movement.

Each spindle turns around its own shaft driven by an alternate current induction motor by means of a belt, preferably of the flat type with interior teeth. Each motor is individually controlled by a frequency variator, of the conventional, vectorial or other type, which is programmed independently for each spindle by means of a potentiometer located in each spindle control panel, so that each spindle can turn at a different speed and have an opposite turning direction.

The ring rail can move vertically along two vertical guides, one in each side cabinet. The guides are of cylindrical shape and are made of carbon steel and fastened in the bottom to each cabinet forming the machine frame. The ring rail moves vertically up and down with a stroke equivalent to the spindle reel height, and can regulate the length of the stroke. The thread guides move above the ring rail, following a similar motion pattern, along the guides.

The ring rail as well as the thread guides are driven by an alternate current electric motor, provided with a speed variator of the manual regulation disc type. The variator transmits the turning movement to a speed reduction unit by means of the flat teethed belt. The output of the reduction unit is a horizontal shaft driving two drums with a different diameter on which steel cables are wound which hold the thread guides and the ring rail. The vertical up and down displacement is created as a consequence of the reverse in the motor turning direction, by means of the control provided by limit switches mounted on the drums. The thread guides and the ring rail are driven by the same means and the same motor with reduction unit, so that they all have the same frequency of movement.

The feeding rollers are mounted on two horizontal cross shafts vertically one on top of the other, and are driven through a flat belt transmission system by an alternate current motor controlled by a conventional frequency variator which, in turn, is controlled by a potentiometer. The turning movement is transmitted between both of them by means of a driving chain, so that both shafts turn in the same direction.

The driving motor as well as the frequency variator and the control potentiometer are located in the cabinet. Finally, the swing arm of each pressure roller is actuated by means of a pneumatic cylinder.

For a better understanding of the new continuous, individual conical or double conical folding system, first we will explain the process to obtain a conventional simple conical folding as it is used now. A conventional reel, comprising a cylindrical central body with its bottom provided with a disc having a diameter between two and five times the central body diameter to support the processed thread, will be inserted in spindles of a spinning and doubling machine. The upper part of the reel has another disc, with a diameter slightly larger than that of the central body. The processed thread is inserted in the central body bottom part of the reel, driving the spinning and doubling machine so that the reel turns, driven by the spindle. By means of the up and down displacement of the sliding piece, driven by the ring rail in which the processed thread is inserted, the thread will be wound or folded around the reel in an upwards direction. As a result, once the reel central body is covered with a first coat, a second coat is folded in a downwards direction. This process is repeated successively to get a diameter slightly smaller than that of a reel bottom disc, in a manner such that each coat presents a height slightly smaller than the previous coat. The result is a mixed pattern bobbin, in which approximately the lower two-thirds of the bobbin has a cylindrical shape and the upper one-third has a truncoconical shape resulting in folded material having an improved stability.

With the new continuous, individual, conical or double conical folding system, the process to obtain a bobbin is totally different from the conventional process. In the conventional process, the thread or welt is folded in accordance with a bobbin simple pattern, with most of its length being of cylindrical shape and truncoconical upper portion. In contrast, with the new continuous, individual, conical or truncoconical folding system, the folding pattern corresponds to a bobbin made up of multiple concentric cylinders and truncocones, forming assemblies called "subcycles" Each of the subcycles comprises a smaller given number of thread or welt coats, with respect to the conventional system, and each subcycle has a height slightly lower than that of a previous subcycle. When the assembly has a given number of subcycles, it is called a "repeated great cycle".

With this improvement, the modular machine for spinning and doubling with individual transmission elements for spindles is provided with a control unit comprising a microprocessor. The microprocessor enables the machine to program, on a display, the length required to be stored in each reel, the reel length, the height (h) of the cone or truncocone, and by means of a display restricted to the user, the number of subcycles (m) and number of thread or welt coats in each subcycle (n) in accordance with the features of the processed products. The difference in height between a coat and next coat (Ca) and the difference in height between a subcycle and next subcycle (Cb), computed by means of the microprocessor algorithm, establishes the corresponding parameters.

Also, the microprocessor provides the machine with the capability to program different bobbin shapes, such as single cone, double cone and cylinder. All of these patterns can be obtained under the same process of subcycles and coats as previously described.

With the improvement introduced with the new control unit, the spinning machine, doubling machine, textile spinning, spool roving frame, spool doubling machine, and similar machines, have the capacity to apply the above described programs individually to each spindle of the machine.

BRIEF DESCRIPTION OF THE DRAWINGS

For a better understanding of the invention, a preferential embodiment of the improved modular spinning and doubling machine with individual transmission elements for spindles is shown in the drawings.

DETAILED DESCRIPTION OF THE PREFERRED EMBODIMENTS

Figure 1:
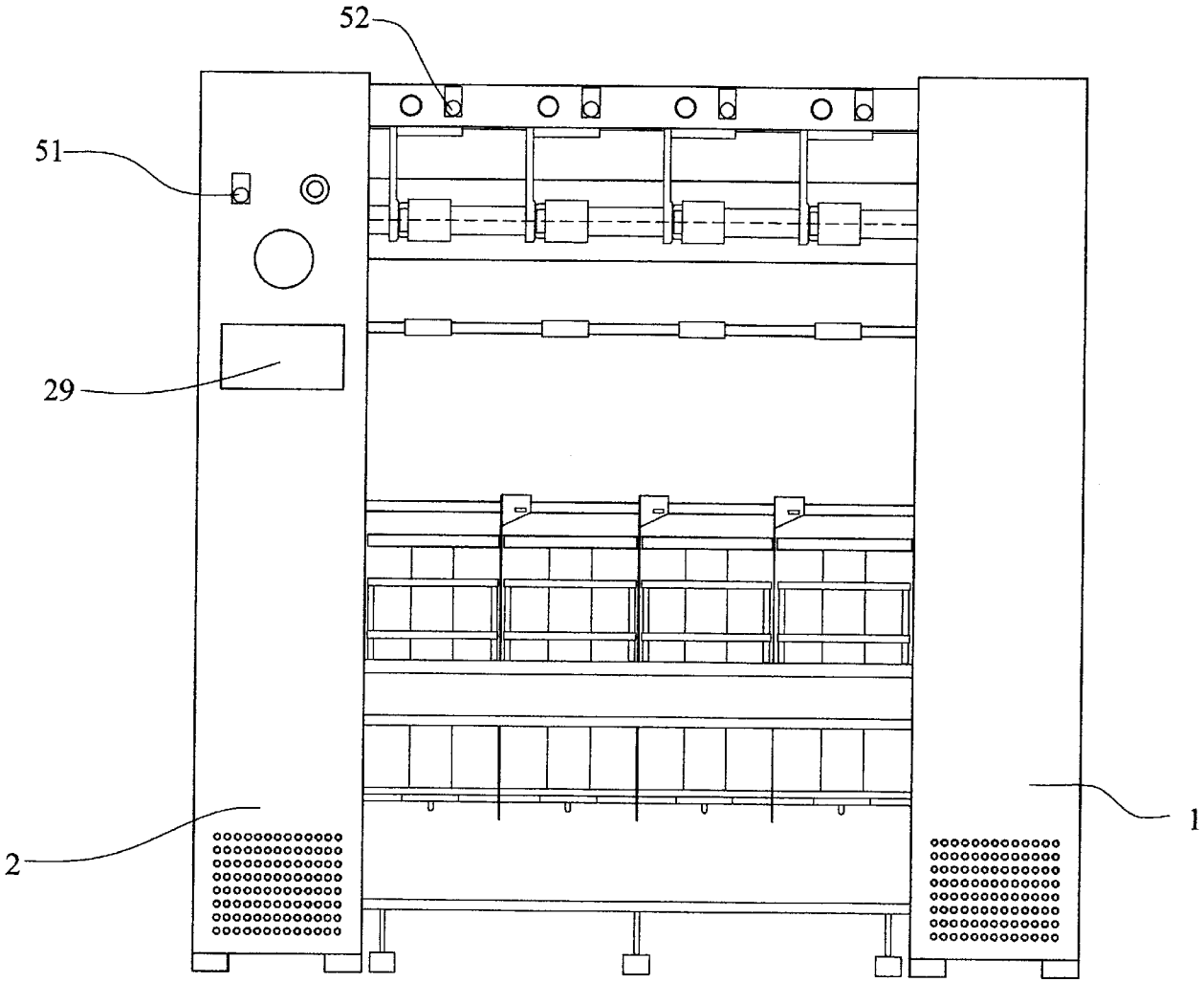
FIG. 1 is a front view of the modular spinning and doubling machine with individual transmission elements for spindles with a continuous, individual, conical or double conical folding system.
Figure 2:
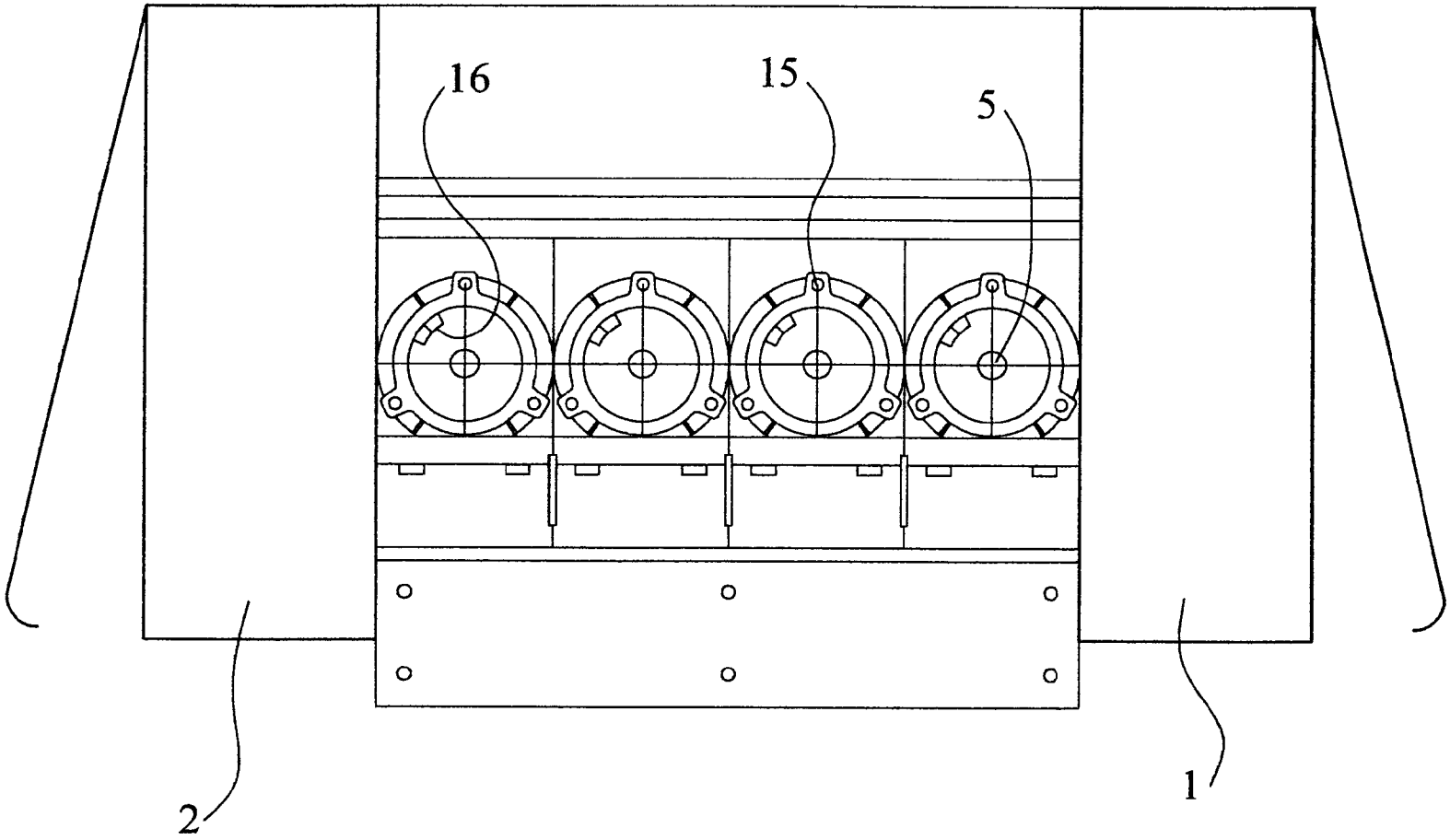
FIG. 2 is a plan view of the modular spinning and doubling machine with individual transmission elements for spindles with continuous, individual, conical or double conical folding system.
Figure 3:
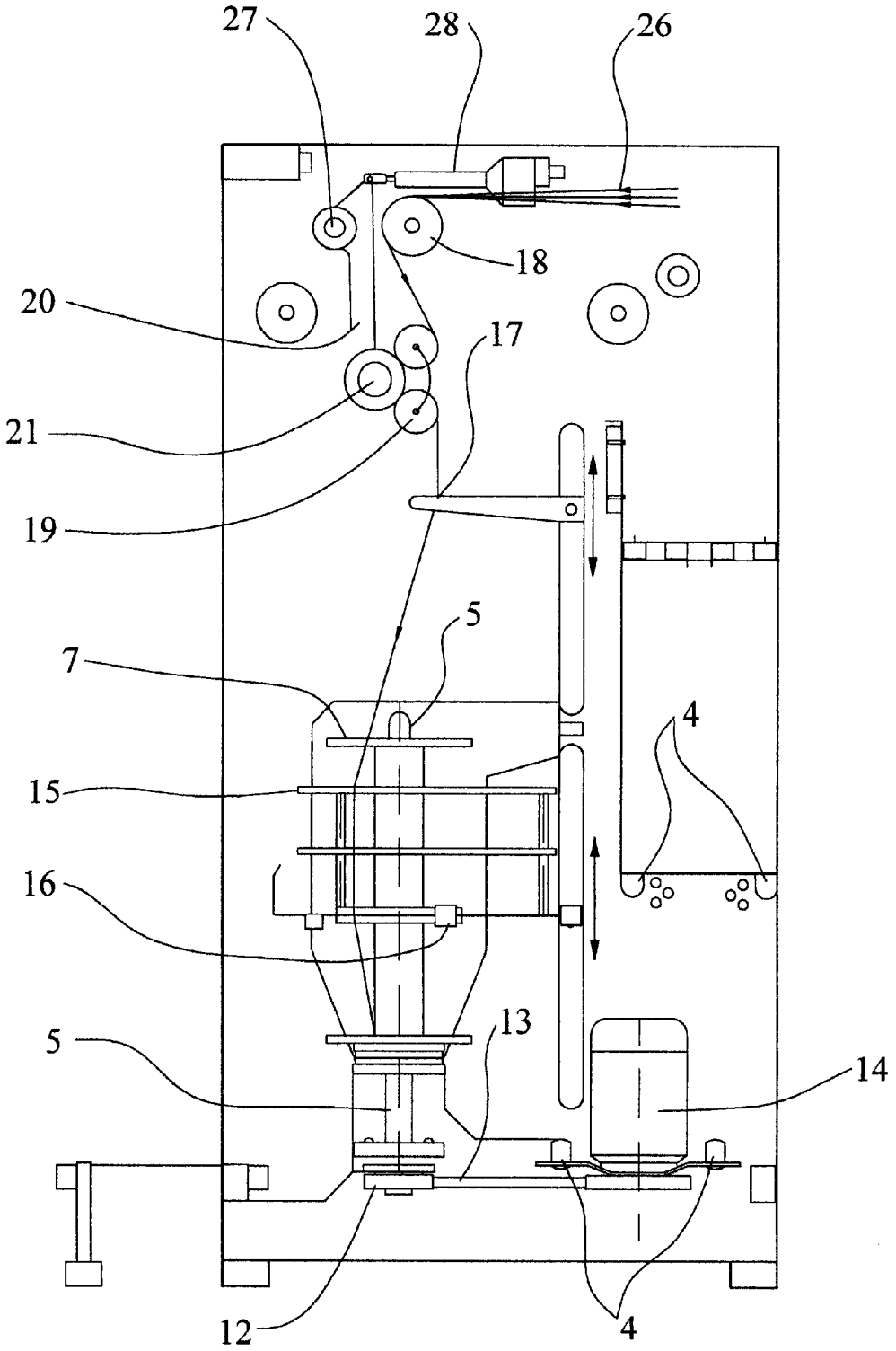
FIG. 3 is a sectional view of an assembly according to the invention.
Figure 4:
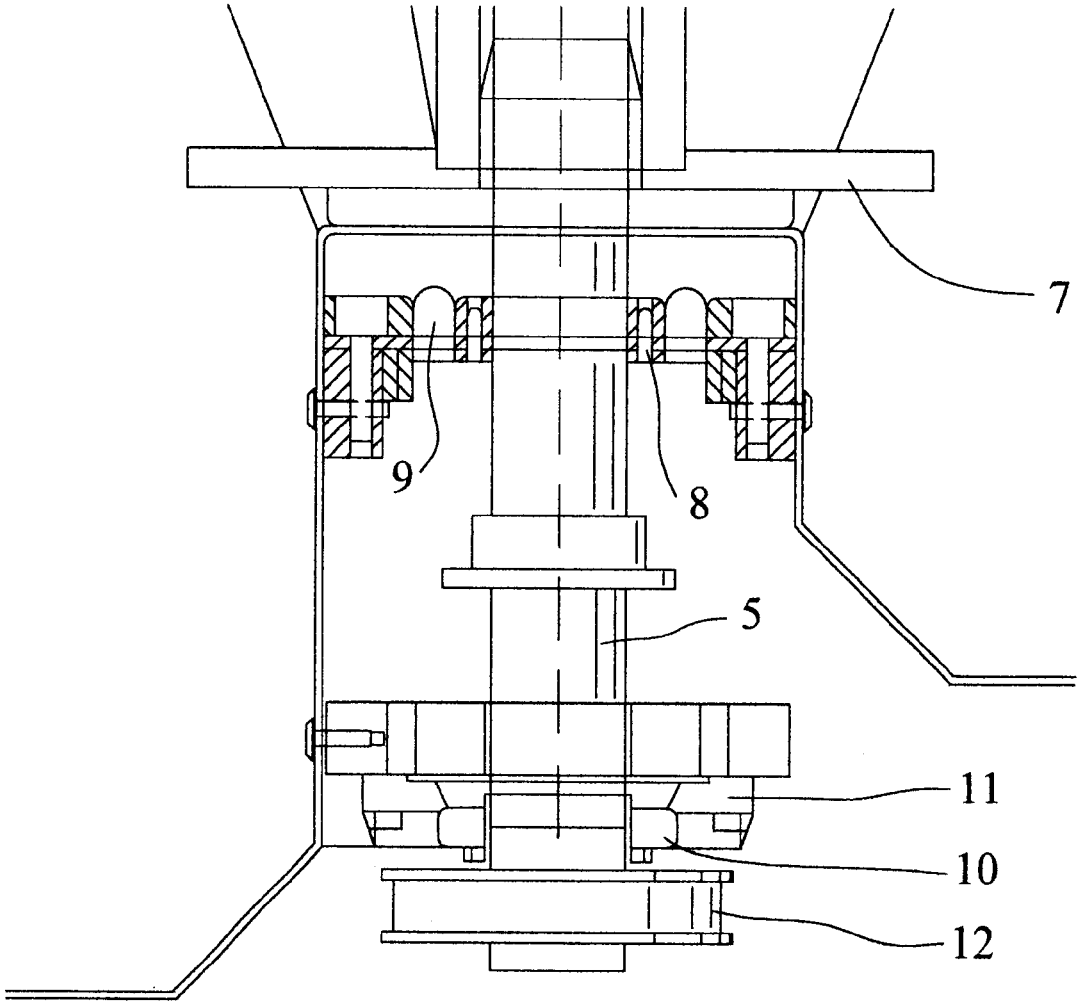
FIG. 4 is a sectional view of a spindles bearing system according to the invention.
Figure 5:
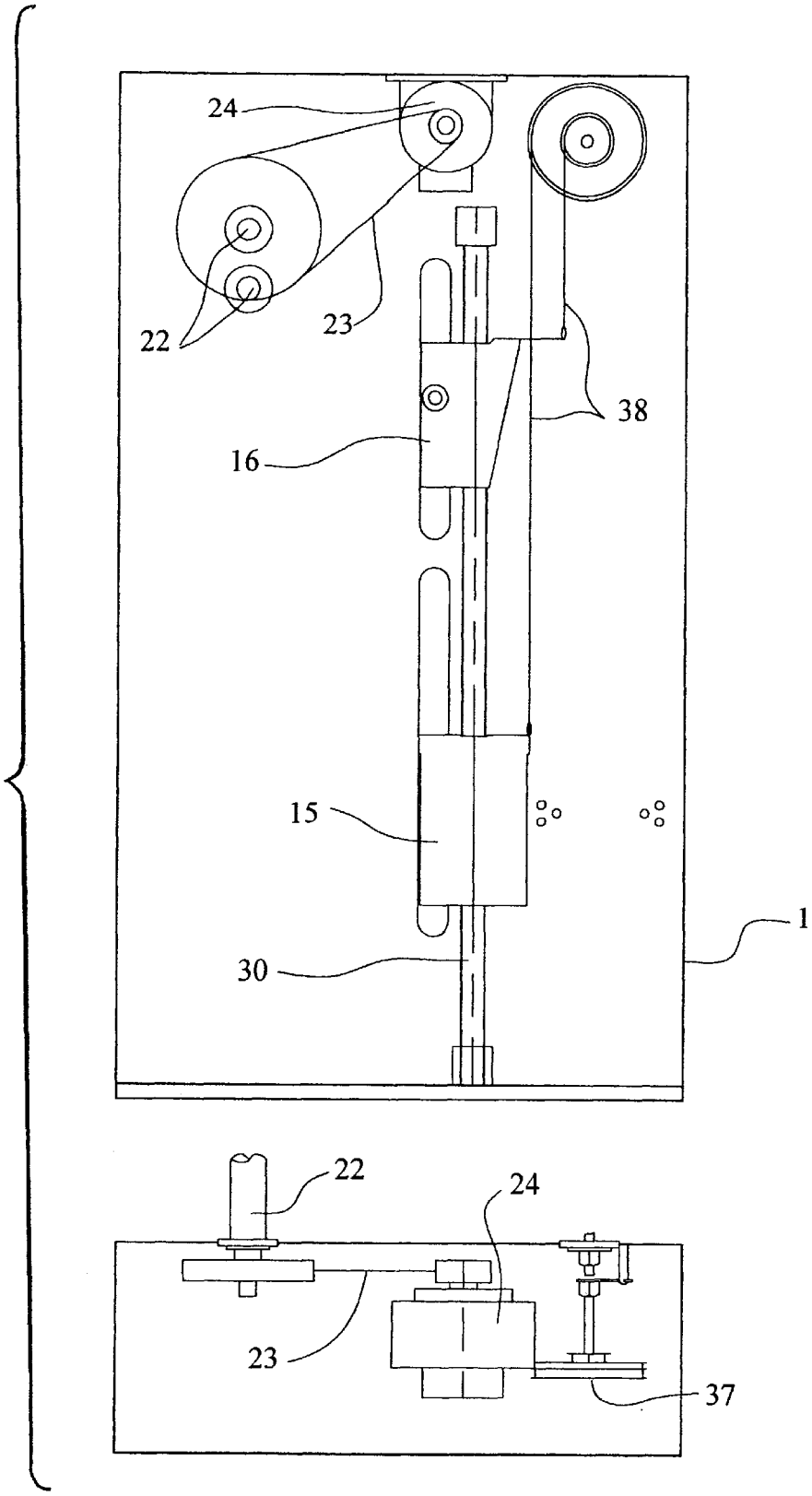
FIG. 5 shows front and plan views of a side of a cabinet according to the invention.
Figure 6:
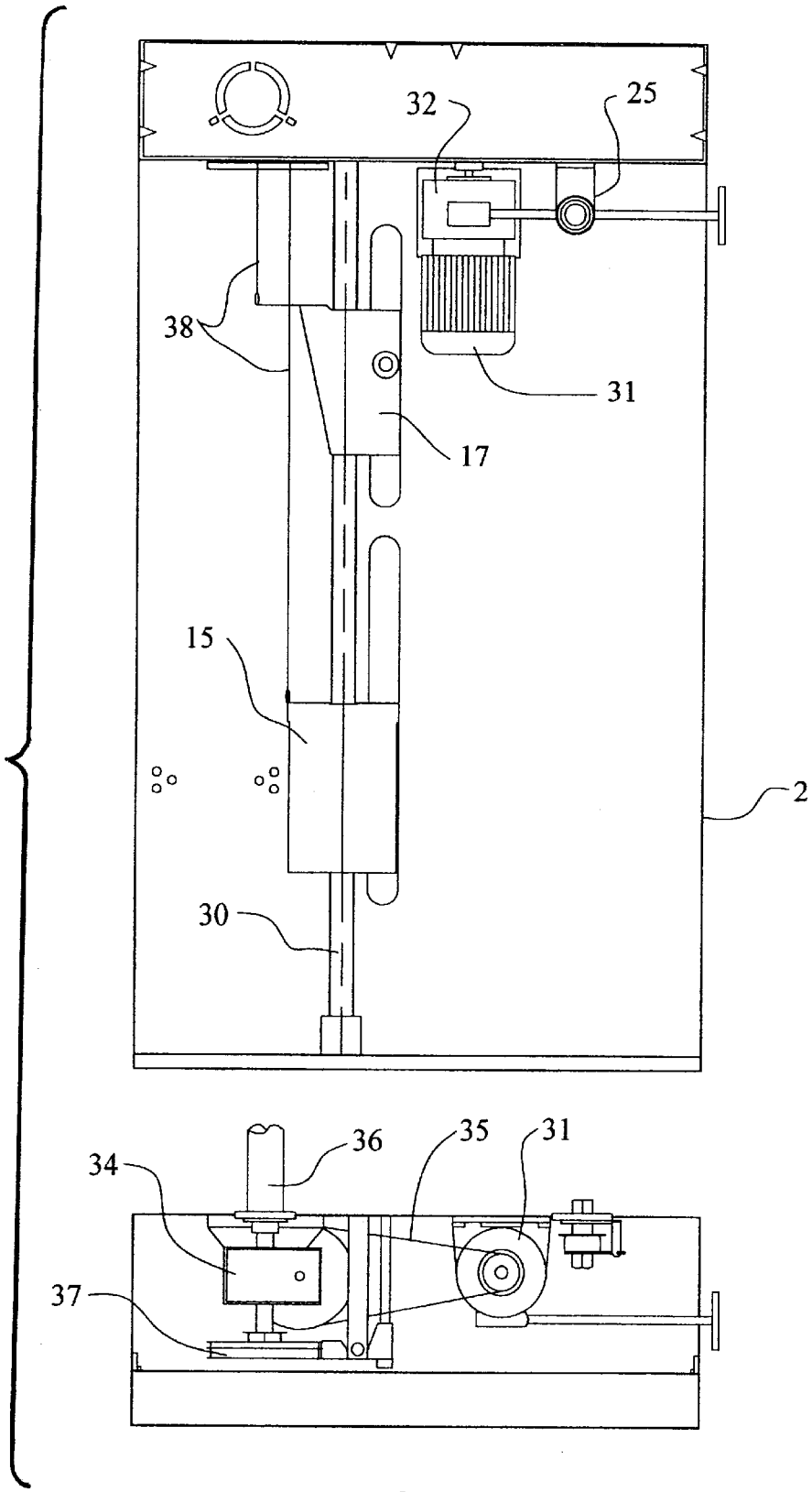
FIG. 6 shows front and plan views of a side of a cabinet according to the invention.
Figure 7:
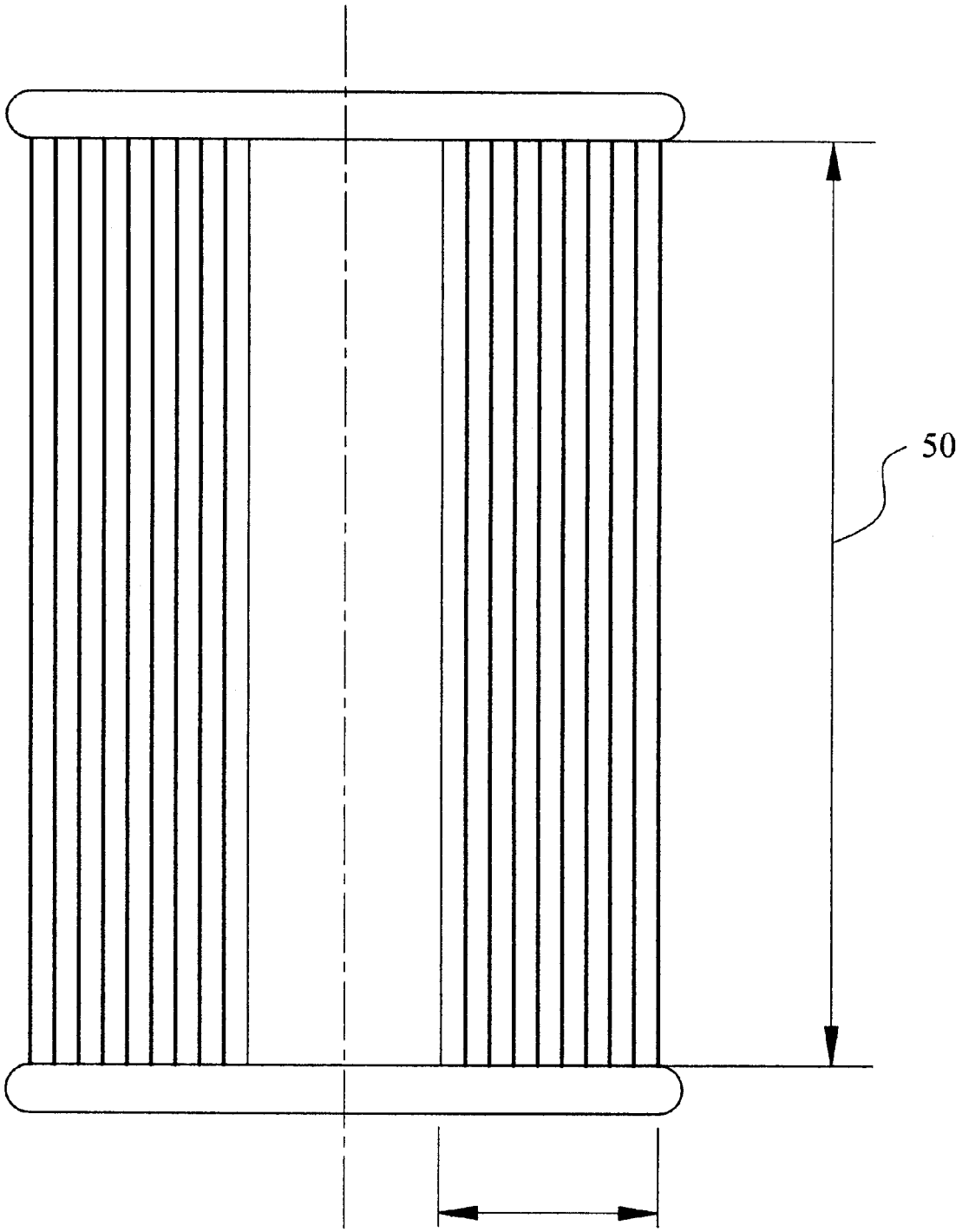
FIG. 7 is a front view of a cylindrical reel with two identical discs.

The modular spinning and doubling machine with individual transmission elements for spindles with continuous, individual, conical or double conical folding system is made of a frame composed by two metal cabinets, one at the left (2) and the other at the right (1) hand side. The frame has a vertical cubic shape, made preferably in steel plate. The exterior of each cabinet has a pivoting access door. The central portion of the frame, connecting the two cabinets fastened by bolts, is provided with cross bars made preferably of welded steel tubes which support moving elements described hereinafter.

The central portion of the frame can contain, within the space between both cabinets (1, 2) and held by the cross tubes (4), between one and thirty spinning or folding spindles (5), each having its own driving means. The spindles (5) are turning vertical to the axis on which the different types of spinning or folding reels will be mounted. The spindles (5) are held by a twin roller system of the ball bearing type. The upper bearing unit (8) is packed in connection with a synthetic rubber ring (9) to absorb the radial vibrations, and the lower bearing unit (10) is mounted on a swinging support (11) that is allowed to be displaced radially.

The spindle bottom part is fastened to a pulley (12) that is arranged to receive a transmission flat belt(13), for connection to the output of an induction electrical motor (14) mounted on a pair of crossing tubes placed in the back side of the frame.

A ring rail (15), having a vertical up and down displacement, on which a sliding piece (16) rotates to create the twisting of the thread, is mounted coaxially on the spindle (5) head. Above this ring rail (15), there is a thread guide (17) having a similar movement but with a different speed. The said thread guide having the purpose of guiding the different threads towards the sliding piece (15) coming from the hake box or feeding assembly.

The feeding assembly for each spindle comprises a pair of feeding rollers (19), an inlet thread roller (18) and a pressure cylinder (21). The feeding rollers (19), are made preferably of chromed carbon steel, and are driven by means of two horizontal shafts (22), which are also driven, through a flat belt (23) transmission system by an alternate current motor (24) controlled by a conventional frequency variator, controlled by the control unit or microprocessor (29). The shafts are made of carbon steel and go through from one cabinet to the other supported by the cabinets. One shaft is located vertically above the other. The shafts are connected to each other by means of a chain (25) that makes them turn in the same direction. The pressure roller (21) is located between the two feeding rollers (19) and exerts a pressure on the threads (26) in order to obtain a better draw. The pressure roller is held by means of ball bearings. The pressure arm (20) is also fastened by means of bearings to another horizontal shaft (27) placed on top of those supported by the feeding rollers (19). The pressure arm (20) is allowed to move radially when actuated by a pneumatic piston (28) as to exert more or less pressure on threads moving through the pressure roller (21) and feeding rollers (19). The pneumatic pistons (26) acting on the pressure rollers (21) of the feeding system in each spindle are driven by the pressured air flow coming from the air pressure piping system, with pressure regulated by a pressure control valve located in the left hand side cabinet.

In the modular machine for spinning and doubling with elements for spindle individual transmission with conical or double conical continuous and individual folding system, spindles (5) are the main elements that are in continuous movement, and are able to turn at different speeds. The ring rail has a vertical up and down movement, with the sliding pieces (16) and thread guides (17) turning around and having, as in the case of the ring rail (15), a vertical up and down movement, the feeding rollers (19), the pressure rollers (21) and the inlet thread rollers (18).

Each spindle (5) turns around its own shaft, driven by an alternate current induction motor (14) by means of a belt (13), preferably of the flat type with interior teeth. Each motor (14) is individually controlled by a frequency variator, preferably of the conventional, vectorial or other type, which is programmed independently for each spindle (5) by means of the control unit or microprocessor (29) located in each spindle control panel, so that each spindle can turn at a different speed and have an opposite turning direction.

The ring rail (15) can displace vertically along two vertical guides (30), one in each side cabinet. The guides (30) are of cylindrical shape and are made of carbon steel and fastened in the bottom to each cabinet (1, 2) forming the machine frame. The ring rail (15) moves vertically up and down with a stroke equivalent to the spindle reel height, so that it is possible to regulate the length of said stroke. The thread guides (17) move above the ring rail, following a similar motion pattern, along the guides.

The ring rail (15) as well as the thread guides (17) are driven by an alternate current electric motor (31) provided with a speed variator (32) of the manual regulation disc type. The variator (32) transmits the turning movement to a speed reduction unit (34) by means of the flat teethed belt (35). The output of the reduction unit is a horizontal shaft (36) driving two drums (37) with different diameters, on which steel cables (38) are wound which hold the thread guides (17) and the ring rail (15). The vertical up and down displacement is created as a consequence of the reverse in the motor (31) turning direction by means of the control provided by limit switches mounted on the drums. The thread guides (17) and the ring rail (15) are driven by same means and the same motor with reduction unit, so that they all have the same frequency of movement.

The feeding rollers (19) are mounted on two horizontal cross shafts (27) vertically, one on top of the other, and are driven through a flat belt transmission system by an alternate current motor (24) controlled by a conventional frequency variator, controlled by a control unit or a microprocessor (29). The turning movement is transmitted, between both of them by means of a driving chain (25) so that both shafts turn in the same direction.

For a better understanding of the new continuous, individual conical or double conical folding system, first we will explain the process to obtain a conventional simple conical folding as it is used now. A conventional reel (7), comprising a cylindrical central body (53) with its bottom provided with disc having a diameter from between two and five times of the central body diameter to support the processed thread, will be inserted in spindles (5) of spinning and doubling machine. The upper part of the reel has another disc with a diameter slightly larger than that of the central body (53). The processed thread is inserted in the central body (53) bottom part of the reel (7), driving the spinning and doubling machine so that the reel (7) turns, driven by the spindle. By means of the up and down displacement of the sliding piece (16), driven by the ring rail (15) in which the processed thread is inserted, the thread will be wound or folded around the reel (7) in an upwards direction so that once the reel central body is covered with a first coat, a second coat is folded in a downwards direction. This process is repeated successively to get a diameter slightly smaller than that of a reel bottom disc, in a manner such that each coat presents a height slightly smaller to that of the previous coat, as to obtain a mixed pattern bobbin, with approximately the lower two-thirds of the bobbin having a cylindrical shape and approximately the upper one-third of the bobbin having a truncoconical shape, resulting in folded material having an improved stability.

Figure 8:
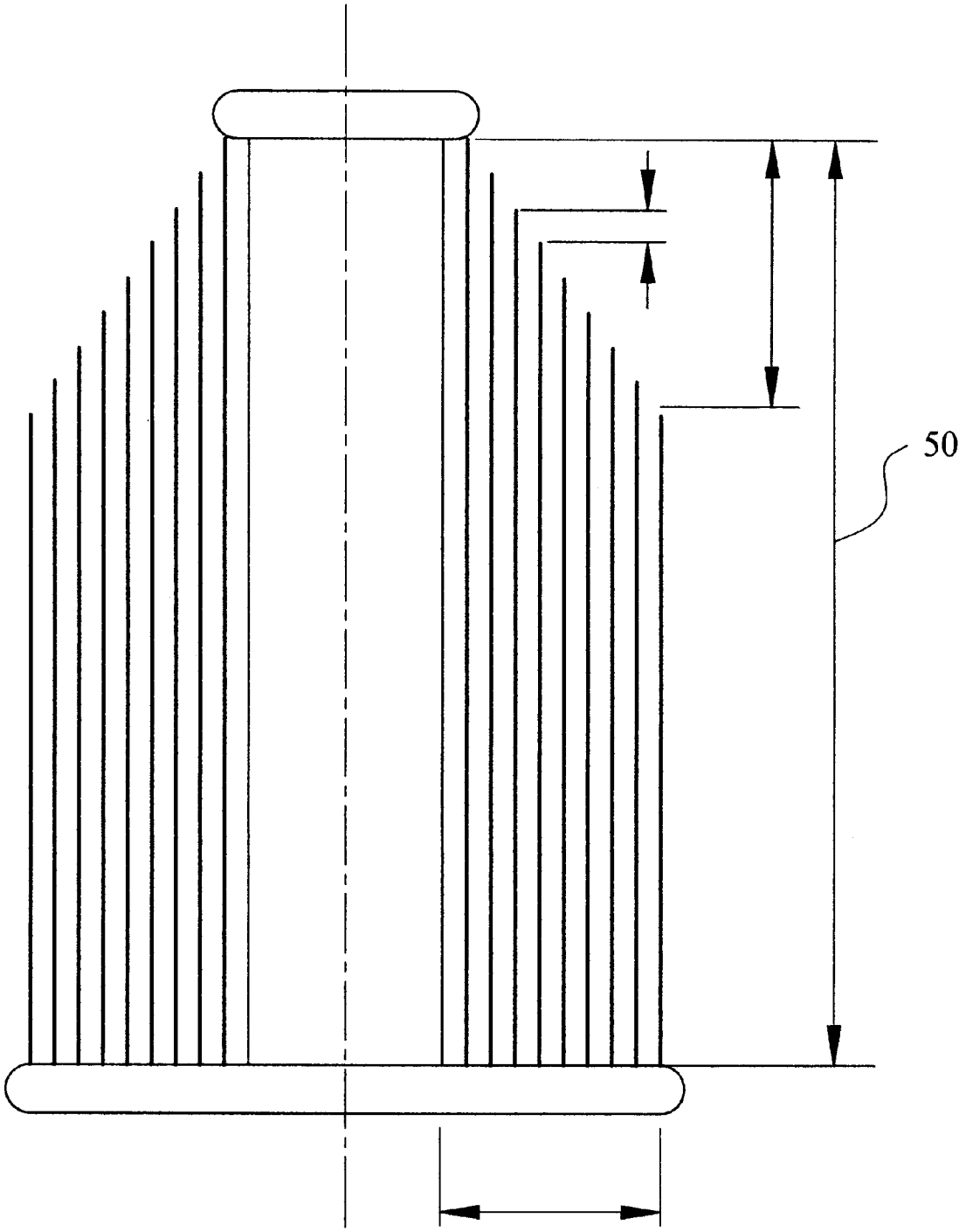
FIG. 8 is a front view of a reel folded in accordance with a conventional process.
Figure 9:
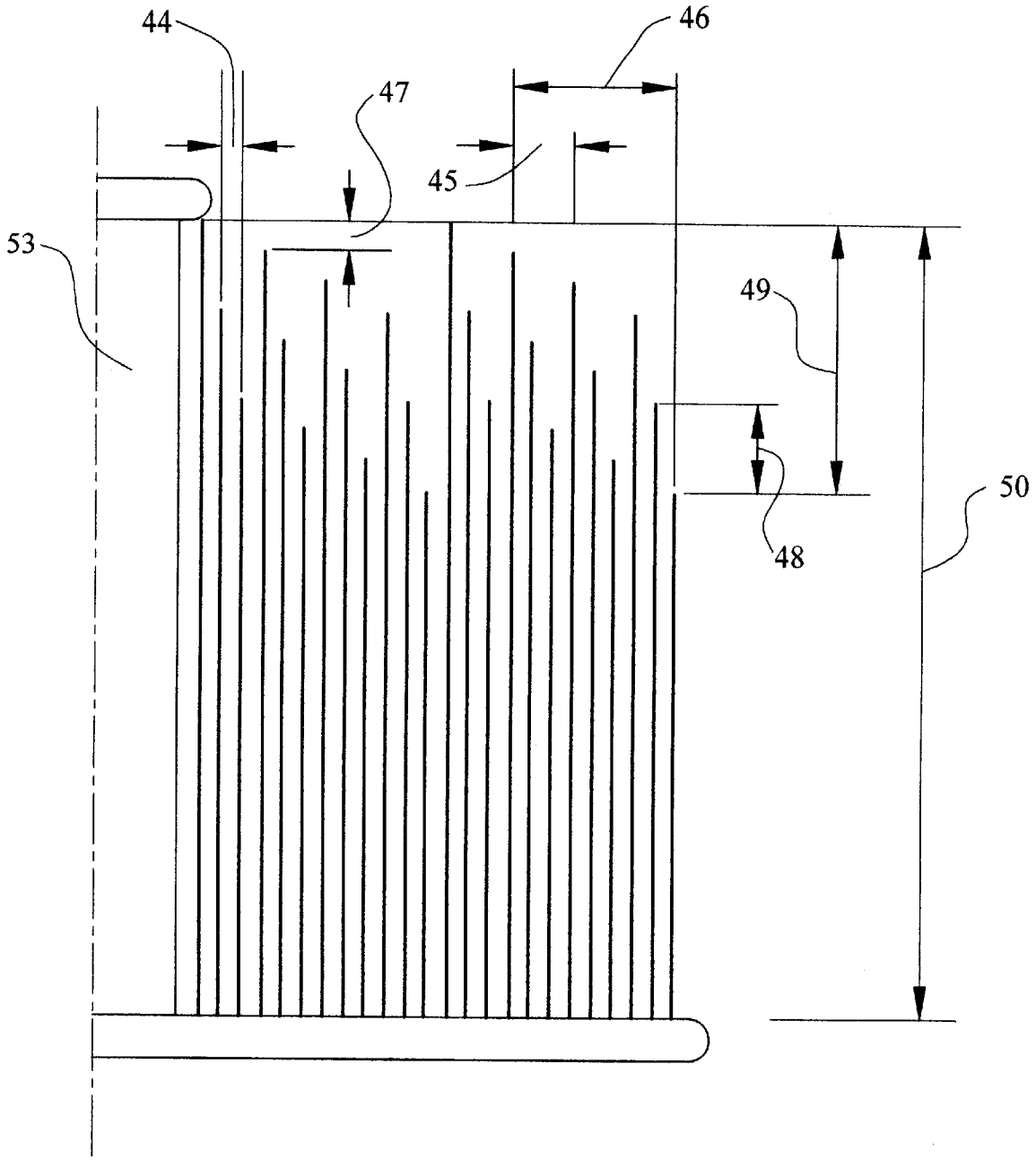
FIG. 9 is a front schematic view of a continuous conical folding process.
Figure 10:
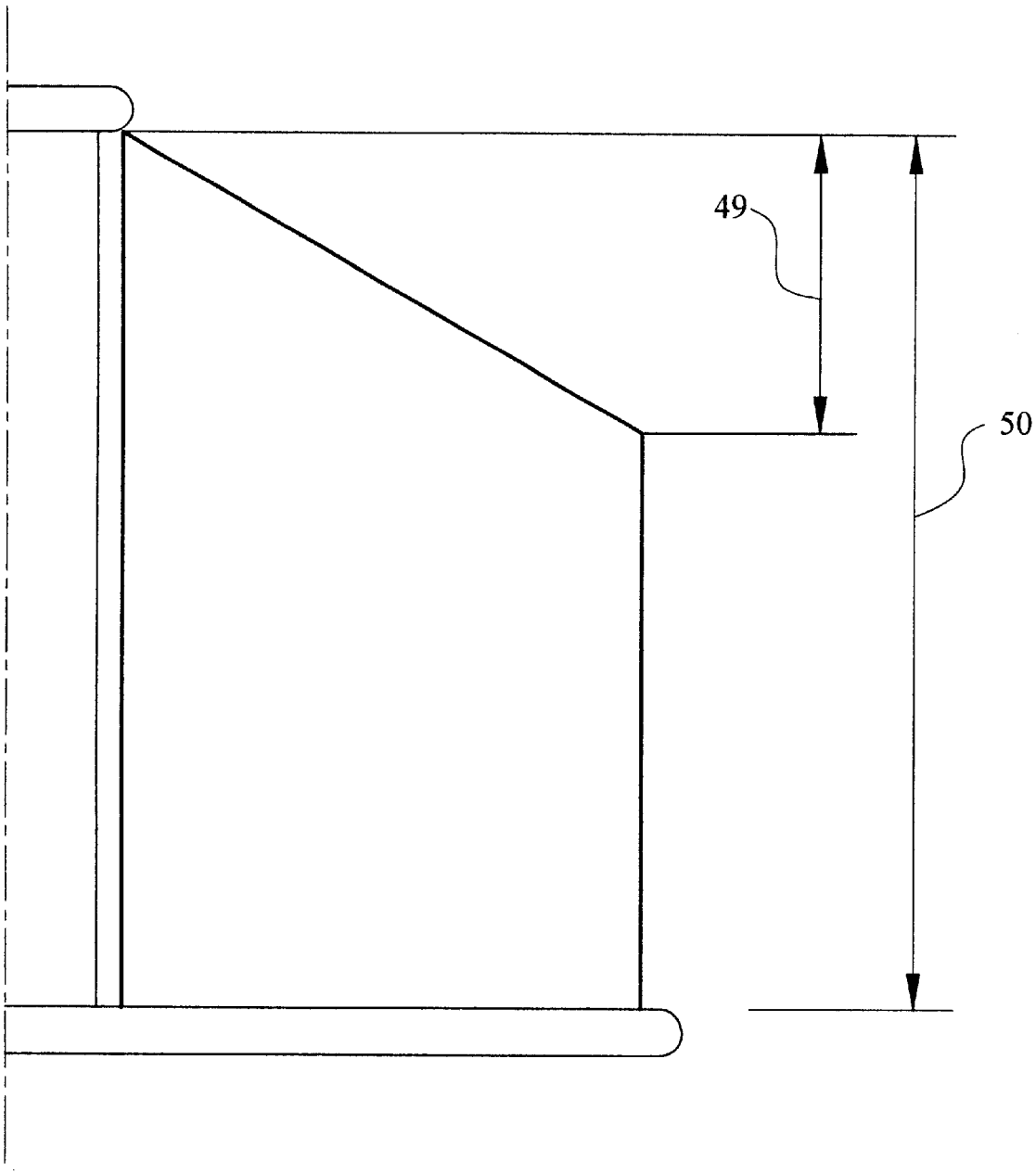
FIG. 10 is a front view of a bobbin which has been configured in accordance with the continuous conical folding process.

With the new continuous, individual, conical or double conical folding system, the process to obtain a bobbin, as shown in FIG. 9, is totally different from the conventional process, shown in FIG. 8. In the conventional process of FIG. 8, the thread or welt is folded in accordance with a bobbin simple pattern, with most of its length having a cylindrical shape and a trunco-conical upper portion, while with the new continuous, individual, conival or trunco-conical folding system the folding pattern corresponds to a bobbin made up of multiple concentric cylinders and trunco-cones, forming assemblies called "subcycles" (45). Each of the subcycles (45) has a smaller given number of thread or welt coats (44) relative to the conventional system, and each subcycle (45) has a height slightly lower than that of a previous subcycle. The assembly having a given number of sub cycles is called a "repeated great cycle" (46).

With this improvement, the modular machine for spinning and doubling with individual transmission elements for spindles is provided with a control unit (29) comprising a microprocessor which enables the machine to program, on a display, the length required to be stored on each reel (7), the reel length, the height (h) (49) of the cone or trunco-cone, and by means of a display restricted to the user, the number of subcycles (m) and the number of thread or welt coats in each subcycle (n) in accordance with the features of the processed products.

The difference in height between a coat and next coat (Ca) (48) and the difference in height between a subcycle and a next subcycle (Cb) (47), computed by means of the microprocessor algorithm, establishes the corresponding parameters.

Also, the microprocessor (29) provides the machine with the ability to program different bobbin shapes, including single cone, double cone, and cylinder. All of these patterns are obtained through the same process of subcycles and coats as previously described.

With the improvement introduced with the new control unit (29), the spinning machine, doubling machine, textile spinning, spool roving frame, spool doubling machine and similar machines, have the capacity to apply the above described programs, individually to each spindle of the machine.

In order to start the process, an operation cycle is programmed for each spindle by means of the display (29) of the control unit or microprocessor by introducing the following data: twist degree, bobbin shape (simple cone, double cone or straight), length to be processed in each spindle, conical (49) and the reel height (50).

Subsequently, the different threads (26) are inserted to form the final thread or welt through the inlet rollers (18), then feed through the feeding rollers (19) and pressure roller (21), through the thread guides (17) and the sliding piece (16), and then wound on the reels (7).

With the pressure arms up (20) and the spindles (5) stopped, the feeding rollers (18), the ring rail (15) and the thread guide (17) are started by means of the feeding system start switch (51). Further, the motors driving the spindles are started in sequence by means of individual switches.

The twist index is given by the control unit or microprocessor (29) to the frequency variator in each motor based on turning speed of each spindle provided by the encoder or motor pulse generator and by the turning speed of the feeding rollers, also provided by the pulse generator or encoder of the frequency variator of feeding rollers driving motor.

Simultaneously, the operation cycle is started, winding or folding the thread or welt on the reel central body (53) with upwards movement and when reaching the maximum reel height by the action of the ring rail sliding piece, the thread or welt starts folding next coat in downwards direction, in this case of smaller height since it is conditioned by the programmed dimension of high cone (48), and so on to configure a complete subcycle (45) with n coats (44) which will start the configuration of a new subcycle, with the same number of coats than the previous one, which in accordance with the low cone (47) dimension, will be of smaller height than the previous one, and so on, to the point in which, as a consequence of the programmed length to be folded on each reel, the reel will stop whereas the remaining spindles will continue the process without being required to stop. Once the filled reel is replaced with an empty reel, the individual starting switch (52) is turned on to initiate the reel operation, starting a new folding process.

It is possible to introduce changes in shape, arrangement and constitution in the assembly and its components, as long as those alterations do not affect substantially the characteristics of the invention as claimed below.

What is claimed is:

1. A modular spinning and doubling machine, with individual transmission elements for spindles and a continuous, individual, conical and double conical folding system, comprising:

said spindles, wherein said spindles have individual driving systems;

wherein said driving systems having a pulley, and a flat transmission belt actuated by an alternate current asynchronous electric motor, fed through a frequency variator which is controlled by a control unit;

wherein said driving systems configure said machine for processing the desired twist degree on each individual spindle, allowing processing threads of different twist degree at the same time on each of said spindles; and wherein said folding system includes said control unit, said folding system configuring said machine for obtaining in said machine, on said each individual spindle, the same final bobbin formats, even when processing threads of different type and torsion degree, and different bobbin filling time on each of said spindles, in a continuous way and without stopping the folding cycle.

2. The machine according to claim 1, wherein said control unit configures said machine to operate at different parameters corresponding to the torsion degree of each thread, each thread being processed at each of said spindles, whereby said folding system processes threads of different torsion degree, width and spinning direction, in said machine at the same time on each of said spindles, thus independently stopping each of said spindles when the programmed length of thread has filled a corresponding bobbin.

3. The machine according to claim 1, wherein said folding system is programmed according to desired bobbin height, conical and double conical format, and conical and programmed length of thread to fill said corresponding bobbins;

wherein the filled bobbins have the same final format regardless of whether said machine processes different thread products, or threads of different twist degree, width and spinning direction;

wherein the filling of the bobbins does not stop except when the spindle has been filled with the programmed length of thread, requiring replacement of the thread; and wherein the bobbins are filled without any influence of the individual bobbin filling cycles, when the filling of remaining bobbins begins.

4. The machine according to claim 1, wherein the variables "m", "n", "Ca". "Cb" and "h" according to the expressions "Ca=h/m" and "Cb=h/(m*n) are fixed to the necessary values in order to guarantee a swinging operation for achieving an individual and independent folding cycle of the thread filled on each corresponding bobbin.

5. The machine according to claim 1, wherein the spindles are supported by a twin bearing system of the ball type, the upper bearing being packed with a synthetic rubber ring capable of absorbing the produced radial vibrations, and the lower bearing being mounted on a swinging support capable of radial displacement, the distance between the bearings being between approximately 150 and 350 mm.

* * * * *